US011527213B2

(12) United States Patent
Shan

(10) Patent No.: US 11,527,213 B2
(45) Date of Patent: Dec. 13, 2022

(54) DRIVING METHOD OF DISPLAY PANEL FOR REDUCING VIEWING ANGLE COLOR DEVIATION AND DISPLAY DEVICE

(71) Applicant: HKC CORPORATION LIMITED, Guangdong (CN)

(72) Inventor: Jianfeng Shan, Guangdong (CN)

(73) Assignee: HKC Corporation Limited, Guangdong (CN)

( * ) Notice: Subject to any disclaimer, the term of this patent is extended or adjusted under 35 U.S.C. 154(b) by 126 days.

(21) Appl. No.: 17/030,774

(22) Filed: Sep. 24, 2020

(65) Prior Publication Data

US 2021/0012728 A1 Jan. 14, 2021

Related U.S. Application Data

(63) Continuation of application No. PCT/CN2019/076172, filed on Feb. 26, 2019.

(30) Foreign Application Priority Data

Jan. 30, 2019 (CN) ..... 201910098295.3

(51) Int. Cl.
*G09G 3/36* (2006.01)
*G09G 3/20* (2006.01)

(52) U.S. Cl.
CPC ..... *G09G 3/3607* (2013.01); *G09G 3/3614* (2013.01); *G09G 3/3677* (2013.01);
(Continued)

(58) Field of Classification Search
CPC .. G09G 3/3607; G09G 3/3614; G09G 3/3677; G09G 3/3648; G09G 3/3688;
(Continued)

(56) References Cited

U.S. PATENT DOCUMENTS 10,424,258 B2 9/2019 Endo
2008/0055300 A1 3/2008 Yamazaki
(Continued)

FOREIGN PATENT DOCUMENTS

CN 101216645 A 7/2008
CN 101308304 A 11/2008
(Continued)

OTHER PUBLICATIONS

Chinese Office Action, dated Aug. 20, 2020, for HKC Corporation Limited, Chinese Application No. 201910098295.3, filed Jan. 30, 2019.
(Continued)

*Primary Examiner* — Adam J Snyder
(74) *Attorney, Agent, or Firm* — Law Offices of Albert Wai-Kit Chan, PLLC

(57) ABSTRACT

A driving method of display panel and a display device are provided, the driving method includes: taking a time duration of scanning at least two adjacent columns of pixel units as a driving period, a common electrodes of sub-pixels in the pixel units of a preset row are driven by different preset voltages in the current driving period, and the sub-pixels does not need to be driven by doubling the metal wiring and the driving device, thus to achieve the purpose of saving cost; and when the preset voltage is a positive or negative polarity driving voltage, the high voltage sub-pixel and the low-voltage sub-pixel in the pixel unit are driven by a preset driving mode.

18 Claims, 6 Drawing Sheets

(52) U.S. Cl.
CPC ..... *G09G 3/3688* (2013.01); *G09G 3/3696* (2013.01); *G09G 3/20* (2013.01); *G09G 3/3648* (2013.01); *G09G 2300/0452* (2013.01); *G09G 2320/028* (2013.01); *G09G 2320/0242* (2013.01)

(58) Field of Classification Search
CPC ..... G09G 3/3696; G09G 3/20; G09G 2300/0452; G09G 2320/0242; G09G 2320/028
See application file for complete search history.

(56) References Cited

U.S. PATENT DOCUMENTS

2008/0088559 A1* 4/2008 Lai ..... G09G 3/3648 345/89
2008/0180371 A1* 7/2008 Shie ..... G09G 3/3648 345/87
2009/0102991 A1* 4/2009 Chen ..... G09G 3/3655 349/33
2009/0278776 A1* 11/2009 Pai ..... G09G 3/3648 345/87
2011/0096050 A1* 4/2011 Lee ..... G09G 3/3655 345/96
2012/0105407 A1* 5/2012 Zhan ..... G09G 3/3614 345/209
2014/0285478 A1* 9/2014 Ono ..... G09G 3/3614 349/33
2014/0313113 A1* 10/2014 Jang ..... G09G 3/3655 345/204

FOREIGN PATENT DOCUMENTS

CN 102778986 A 11/2012
CN 103676389 A 3/2014
CN 106097955 A 11/2016
CN 108107634 A 6/2018
CN 108831405 A 11/2018
CN 109016319 A 12/2018
CN 109256104 A 1/2019

OTHER PUBLICATIONS

International Search Report, dated Nov. 18, 2019, for HKC Corporation Limited, International Application No. PCT/CN2019/076172, filed Feb. 26, 2019.
Written Opinion of the International Search Authority, dated Nov. 18, 2019, for HKC Corporation Limited, International Application No. PCT/CN2019/076172, filed Feb. 26, 2019.

* cited by examiner

DRIVING METHOD OF DISPLAY PANEL FOR REDUCING VIEWING ANGLE COLOR DEVIATION AND DISPLAY DEVICE

CROSS-REFERENCE OF RELATED APPLICATIONS

The present application is a continuation application of International Application with No. PCT/CN2019/076172, filed on Feb. 26, 2019, which claims the benefit of a Chinese Patent Application with No. 201910098295.3, titled "Driving Method of Display Panel and Display Device", filed in the National Intellectual Property Administration, PRC on Jan. 30, 2019, the entire contents of which are hereby incorporated by reference.

TECHNICAL FIELD

The present disclosure relates to the field of display technology, and more particularly relates to a driving method of display panel and a display device.

BACKGROUND

Large size liquid crystal display panels are mostly configured in vertical alignment (VA) type or in coplanar switching (IPS) type. Compared with IPS liquid crystal technology, VA type liquid crystal technology has the advantages of high production efficiency and low manufacturing cost, and also has the obvious defects in optical properties, such as color shift when large viewing angle images are presented.

When displaying an image, the brightness of a pixel should ideally change linearly with the voltage change, so that the driving voltage of the pixel can accurately represent the gray scale of the pixel and be reflected by the brightness. As shown in FIG. 1*a*, when VA type liquid crystal technology is used and the display screen is viewed from a smaller angle of view (e.g., front view), the brightness of the pixel can meet the ideal situation, i.e., it changes linearly with voltage, as shown by the ideal curve in FIG. 1*a*. However, when viewing the display screen at a larger viewing angle (e.g., 160 degrees or more to the display screen), due to the limitation of VA type liquid crystal technology, the brightness of the pixel appears to saturate rapidly with the voltage and then changes slowly, as shown in the actual curve in FIG. 1*a*. As a result, the gray scale that the driving voltage should have presented at a large viewing angle has seriously deviated, i.e. has a color shift.

The traditional way to improve color shift is to subdivide each sub-pixel into a main pixel and a subpixel, then the main pixel is driven with a relatively high driving voltage and the subpixel is driven with a relatively low driving voltage. One sub-pixel are displayed by the main pixel and the subpixel together. The relatively high driving voltage and the relatively low driving voltage can maintain a constant relationship between brightness and corresponding gray scale at the front viewing angle when driving the main pixel and the subpixel. Generally, in the first half of the gray scale, the main pixel is driven and displayed with a relatively high driving voltage and the subpixel does not display in the manner shown in FIG. 1*b*, and the brightness of the whole sub-pixel is half that of the main pixel. In the second half of the gray scale, the main pixel is driven and displayed with a relatively high driving voltage and the subpixel is driven and displayed with a relatively low driving voltage, and the brightness of the whole sub-pixel is half of the sum of the brightness of the main pixel and the brightness of the subpixel. After this synthesis, the luminance curve at a large viewing angle is the actual curve in FIG. 1*b*, which is closer to ideal curve, so that the color shift under a large viewing angle is improved.

However, the problem with the above method is that double the number of metal traces and driving devices are needed to drive the subpixels, so that the transparent opening area is sacrificed, the light transmittance of the panel is affected, and the cost is also higher.

SUMMARY

The present disclosure provides a driving method and a driving device of display panel, and a display device, as well as a storage medium based on data-based integrated drive circuit, which aims to improve large viewing angle color shift and at the same time not increasing the cost.

In order to achieve the above object, the present application provides a driving method of display panel, the display panel includes a display array including pixel units arranged in an array; The driving method includes the following steps:

taking a time duration of scanning at least two adjacent columns of pixel unit as a driving period, in a current driving period, driving a common electrode of sub-pixels in the pixel units of a first row with a first preset voltage, and driving a common electrode of sub-pixels in the pixel units of a second row with a second preset voltage;

if the first preset voltage is a negative polarity driving voltage and the second preset voltage is a positive polarity driving voltage, driving high voltage sub-pixels of the first row with a positive polarity and driving low voltage sub-pixels of the first row with a negative polarity, and driving high voltage sub-pixels of the second row with a negative polarity and driving low voltage sub-pixels of the second row with a positive polarity, wherein the first preset voltage is less than a reference voltage and the second preset voltage is larger than the reference voltage;

periodically inverting the first preset voltage and the second preset voltage when a received data driving signal input by a data driving circuit is inverted; and if the inverted first preset voltage is a positive polarity driving voltage and the inverted second preset voltage is a negative polarity driving voltage, driving the high voltage sub-pixels of the first row with a negative polarity and driving the low voltage sub-pixels of the first row with a positive polarity, and driving the high voltage sub-pixels of the second row with a positive polarity and driving the low voltage sub-pixels of the second row with a negative polarity, wherein the inverted first preset voltage is larger than the reference voltage and the inverted second preset voltage is less than the reference voltage.

In addition, in order to achieve the above object, the present application also provides a driving method of a display panel, the display panel includes a display array, the display array includes pixel units arranged in an array, the pixel units includes first pixel units and second pixel units, first columns are all formed by the first pixel units and second columns are all formed by the second pixel units, the first columns and the second columns are alternately arranged, the pixel units sequentially includes a red sub-pixel, a green sub-pixel, and a blue sub-pixel in a row direction, any adjacent sub-pixels in the pixel units are alternately driven with high and low voltages of different polarities respectively, adjacent sub-pixels in a same column shares one data driving signal; wherein the driving method includes:

taking a time duration of scanning at least two adjacent columns as a driving period, in a current driving period, driving a common electrode of sub-pixels in the pixel units of a first row with a first preset voltage, and driving a common electrode of sub-pixels in the pixel units of a second row with a second preset voltage;

if the first preset voltage is a negative polarity driving voltage and the second preset voltage is a positive polarity driving voltage, driving high voltage sub-pixels of the first row with a positive polarity and driving low voltage sub-pixels of the first row with a negative polarity, and driving high voltage sub-pixels of the second row with a negative polarity and driving low voltage sub-pixels of the second row with a positive polarity, wherein the first preset voltage is less than a reference voltage and the second preset voltage is larger than the reference voltage;

periodically inverting the first preset voltage and the second preset voltage when a received data driving signal input by a data driving circuit is inverted;

if the inverted first preset voltage is a positive polarity driving voltage and the inverted second preset voltage is a negative polarity driving voltage, driving the high voltage sub-pixels of the first row with a negative polarity and driving the low voltage sub-pixels of the first row with a positive polarity, and driving the high voltage sub-pixels of the second row with a positive polarity and driving the low voltage sub-pixels of the second row with a negative polarity, wherein the inverted first preset voltage is larger than the reference voltage and the inverted second preset voltage is less than the reference voltage;

selecting two adjacent sub-pixels in a same row, driving a high voltage sub-pixel and a low voltage sub-pixel in the selected sub-pixels by a same positive polarity driving voltage; and driving the high voltage sub-pixel in the selected sub-pixels with an equivalent driving voltage larger than that of the low voltage sub-pixel in the selected sub-pixels.

In addition, in order to achieve the above object, the present application also provides a display device, the display device includes a display panel, a memory, a non-volatile memory and a processor, the non-volatile memory stores executable instructions, the processor executes the executable instructions to realize the following operations:

taking a time duration of scanning at least two adjacent columns of pixel unit as a driving period, in a current driving period, driving a common electrode of sub-pixels in the pixel units of a first row with a first preset voltage, and driving a common electrode of sub-pixels in the pixel units of a second row with a second preset voltage;

if the first preset voltage is a negative polarity driving voltage and the second preset voltage is a positive polarity driving voltage, driving high voltage sub-pixels of the first row with a positive polarity and driving low voltage sub-pixels of the first row with a negative polarity, and driving high voltage sub-pixels of the second row with a negative polarity and driving low voltage sub-pixels of the second row with a positive polarity, wherein the first preset voltage is less than a reference voltage and the second preset voltage is larger than the reference voltage;

periodically inverting the first preset voltage and the second preset voltage when a received data driving signal input by a data driving circuit is inverted; and if the inverted first preset voltage is a positive polarity driving voltage and the inverted second preset voltage is a negative polarity driving voltage, driving the high voltage sub-pixels of the first row with a negative polarity and driving the low voltage sub-pixels of the first row with a positive polarity, and driving the high voltage sub-pixels of the second row with a positive polarity and driving the low voltage sub-pixels of the second row with a negative polarity, wherein the inverted first preset voltage is larger than the reference voltage and the inverted second preset voltage is less than the reference voltage.

According to the invention, at least two rows of pixel units are scanned as a driving period, the common electrodes of each sub-pixel in the pixel units of the preset row are respectively driven by different preset voltages in the current driving period, and the sub-pixels do not need to be driven by double metal wiring and driving devices to achieve the purpose of saving cost; and when the preset voltages are positive and negative polarity driving voltages, the high-voltage sub-pixels and the low-voltage sub-pixels in the pixel units are driven in a preset driving mode, so that the sub-pixels in the pixel units are arranged in a way of crossing high and low voltages, and the viewing angle color is solved.

BRIEF DESCRIPTION OF THE ACCOMPANYING DRAWINGS

FIG. 1*a* is a relationship graph between a color shift curve and an ideal curve before being improved;

FIG. 1*b* is a relationship graph between the color shift curve and the ideal curve after being improved;

FIG. 2 is a schematic structural diagram of a display device of a hardware operating environment according to an embodiment of the present application;

FIG. 3*a* is a structural diagram of an exemplary display array;

FIG. 3*b* is a driving timing diagram of an exemplary display array;

FIG. 4*a* is a schematic structural diagram of a display array according to an embodiment of the present application;

FIG. 4*b* is a driving timing diagram of a display array according to an embodiment of the present application;

Various implementations, functional features, and advantages of this disclosure will now be described in further detail in connection with some illustrative embodiments and the accompanying drawings.

DETAILED DESCRIPTION OF ILLUSTRATIVE EMBODIMENTS

It is understood that the specific embodiments described herein are merely illustrative of the disclosure and are not intended to limit the disclosure.

Figure 1A:
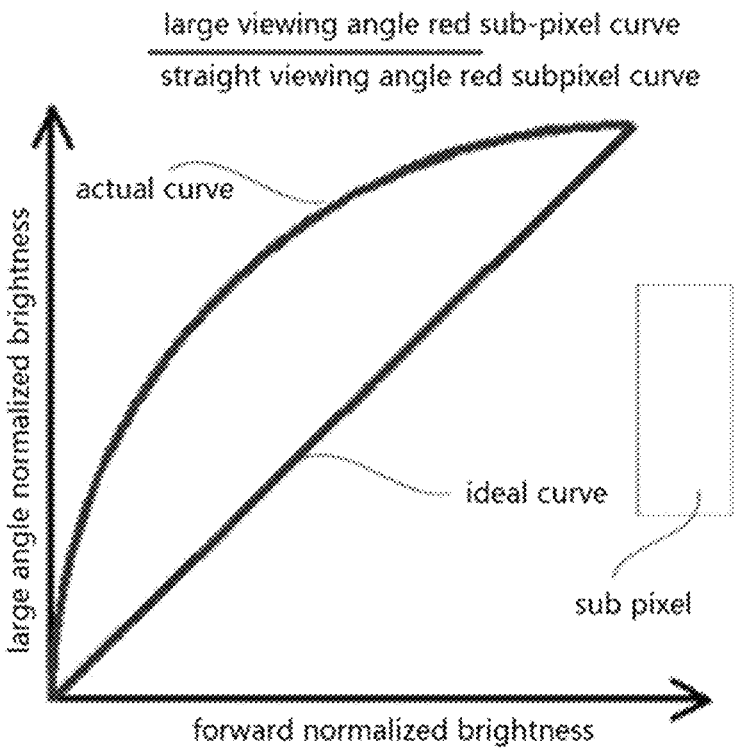
Figure 1B:
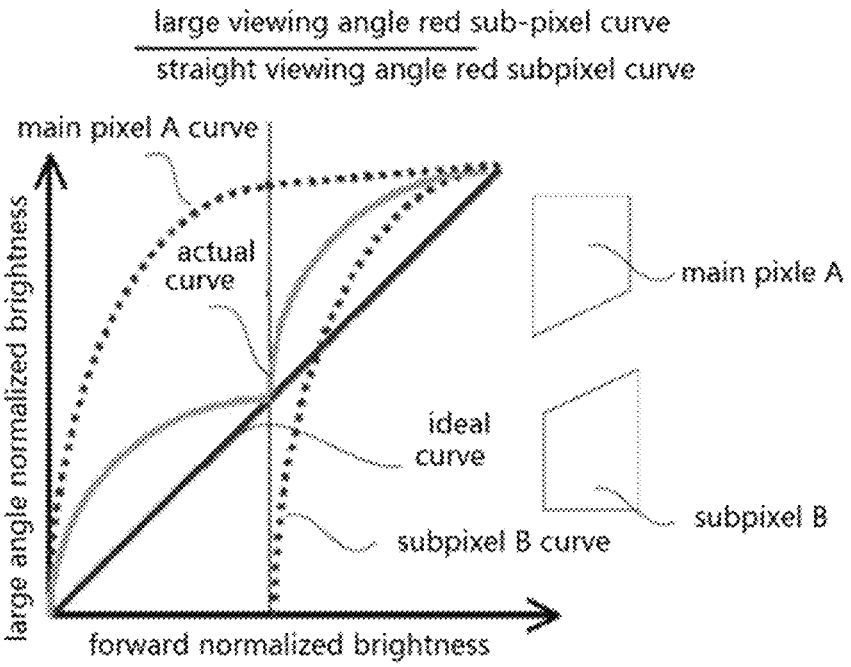
Figure 2:
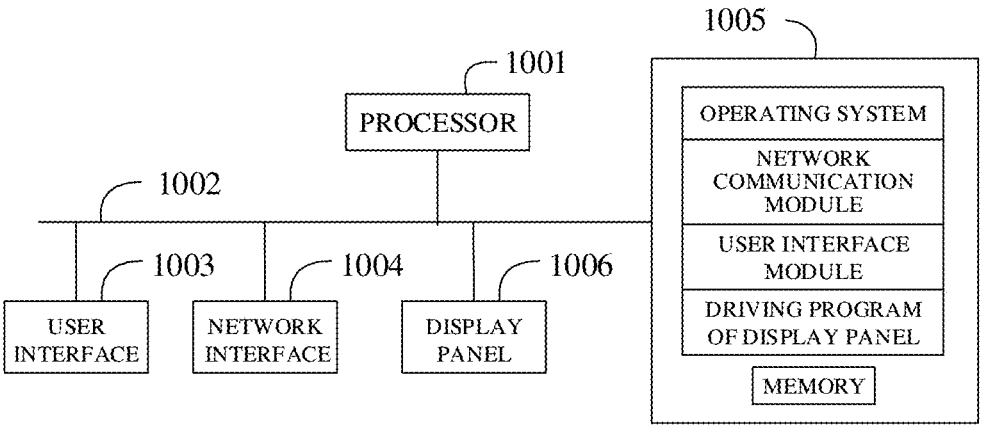

Referring to FIG. 2, FIG. 2 is a schematic structural diagram of a display panel of a hardware operating environment according to an embodiment of the present application.

As shown in FIG. 2, the display panel may include a processor 1001, such as a CPU, a communication bus 1002, user interface 1003, network interface 1004, and memory 1005. The communication bus 1002 is used to implement connection communication between these components. The user interface 1003 may include a display, an input unit such as a keyboard, and the optional user interface 1003 may also include a standard wired interface and a wireless interface. The network interface 1004 may optionally include a standard wired interface, a wireless interface (such as a Wi-Fi interface). The memory 1005 may be a high-speed RAM memory or a non-volatile memory, such as a magnetic disk memory. The memory 1005 may alternatively be a storage device independent of the aforementioned processor 1001, and the display panel 1006 may be a liquid crystal display panel or other display panels capable of performing the same or similar functions.

It will be understood by those skilled in the art that the display panel structure shown in FIG. 2 does not constitute a definition of the display panel and may include more or fewer components than shown, or some components may be combined, or different part arrangements may be used.

As shown in FIG. 2, the memory 1005 as a storage medium may include an operating system, a network communication module, a user interface module, and a driver for a display panel.

In the display panel shown in FIG. 2, the network interface 1004 is mainly used to connect the network and communicate data with the internet; The user interface 1003 is mainly used to connect the user terminal and communicate data with the terminal. The processor 1001 and the memory 1005 in the display panel of the present application may be provided in a data driving integrated circuit that calls the driving sequence of the display panel stored in the memory 1005 through the processor 1001 and performs the operation of the driving method of the display panel.

Based on the above hardware structure, an embodiment of the driving method of display panel of the present application is proposed.

Figure 3A:
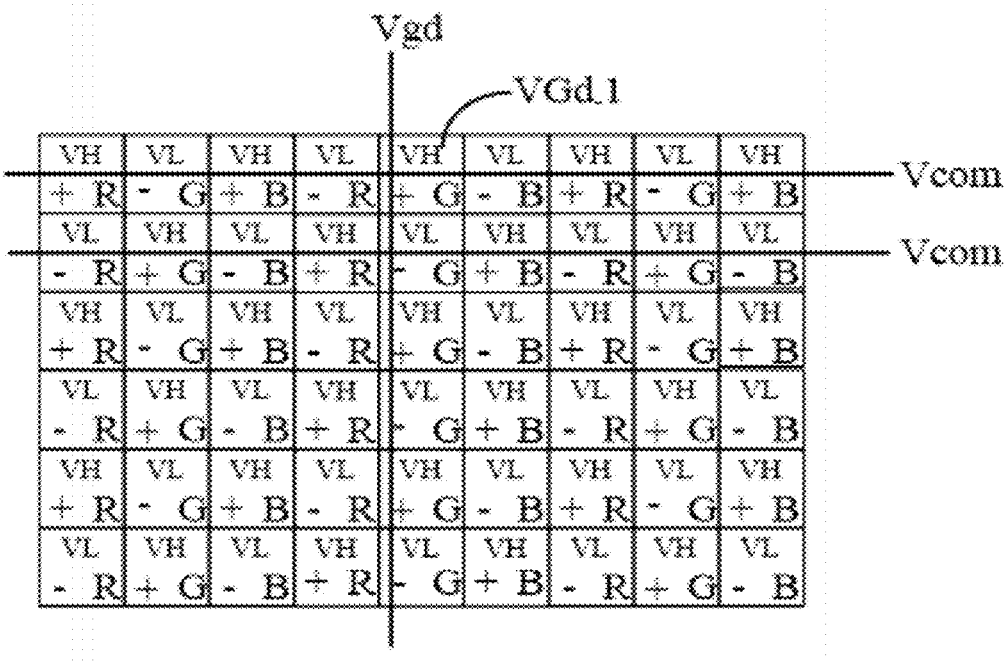
Figure 3B:
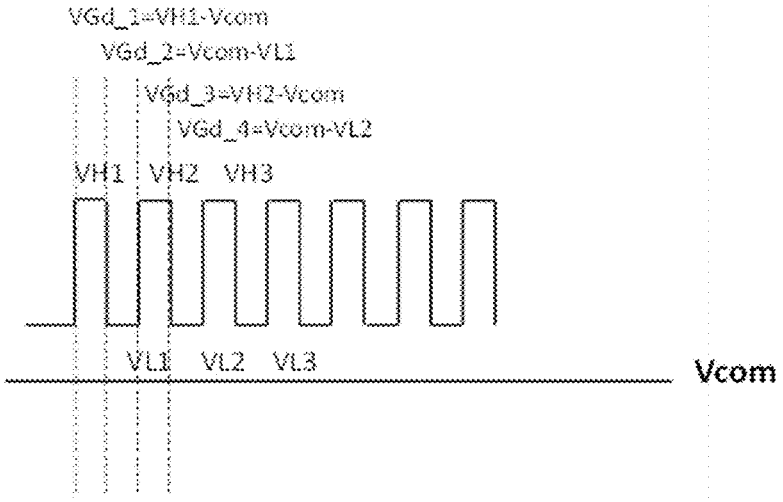

Referring to FIG. 3*a* as an example of the structure of the display array, the common electrode of the original liquid crystal display pixel is designed to pass through the same row of sub-pixels in the same row direction parallel to the gate electrode, as shown in FIG. 3*b* as an example of the driving timing diagram of the display array, the common electrode voltage is a fixed voltage value, and in order to achieve the effect of color shift improvement through high voltage sub-pixels and low voltage sub-pixels, the driving voltage Vd is sequentially driven according to the required voltage of each sub-pixel, as shown in FIG. 3*a*, the equivalent driving voltage VGd_1 of the high voltage sub-pixel is the voltage difference between the driving voltage VH1 and the common electrode Vcom, that is VGd_1=VH1−Vcom. The next adjacent low voltage sub-pixel VGd_2 is the voltage difference between the driving voltage VL1 and the common electrode Vcom, that is, VGd_2=VL1−Vcom, similarly driven by the high voltage and low voltage sub-pixels, as shown in FIG. 3*b*. The voltage driving frequency is VH1, VL1, VH2, VL2 . . . , which is the number of sub-pixel frequency switching of the display column. Therefore, if the display increases with the resolution, the voltage driving frequency of the driving voltage of the same row of pixels will increase. Since the driving signals of the high-voltage sub-pixels and the low-voltage sub-pixels are different, if the adjacent sub-pixels adopt the traditional positive and negative polarity driving method, the driving amplitude of the adjacent sub-pixels will increase, the driving frequency will increase and the driving amplitude will directly cause the power consumption and temperature of driving IC to increase, and the charging ability of pixel formation may decrease, directly reflecting the decrease of the brightness of the panel.

Figure 4A:
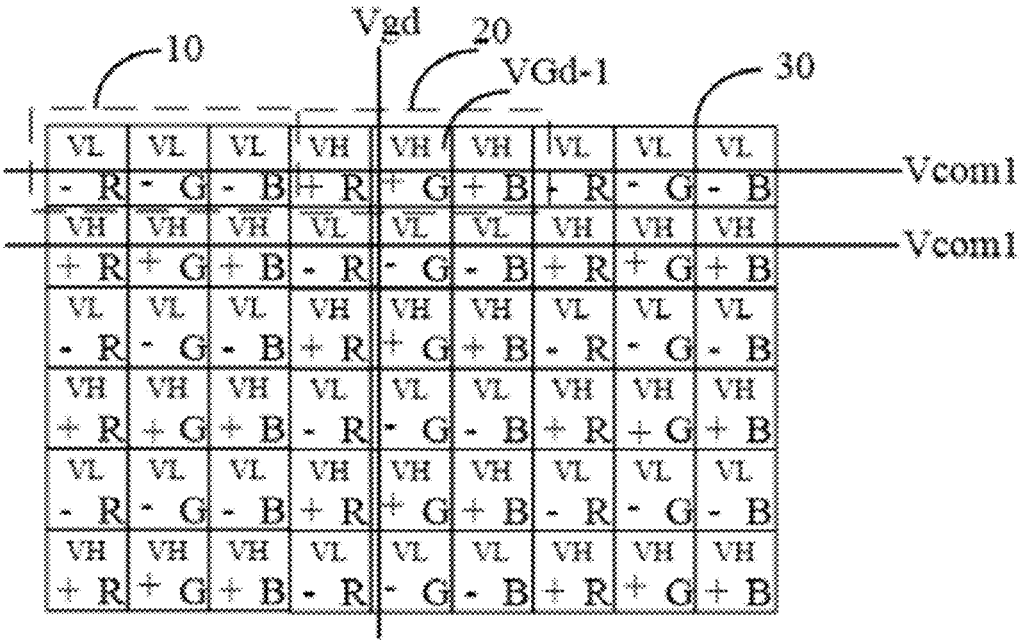
Figure 4B:
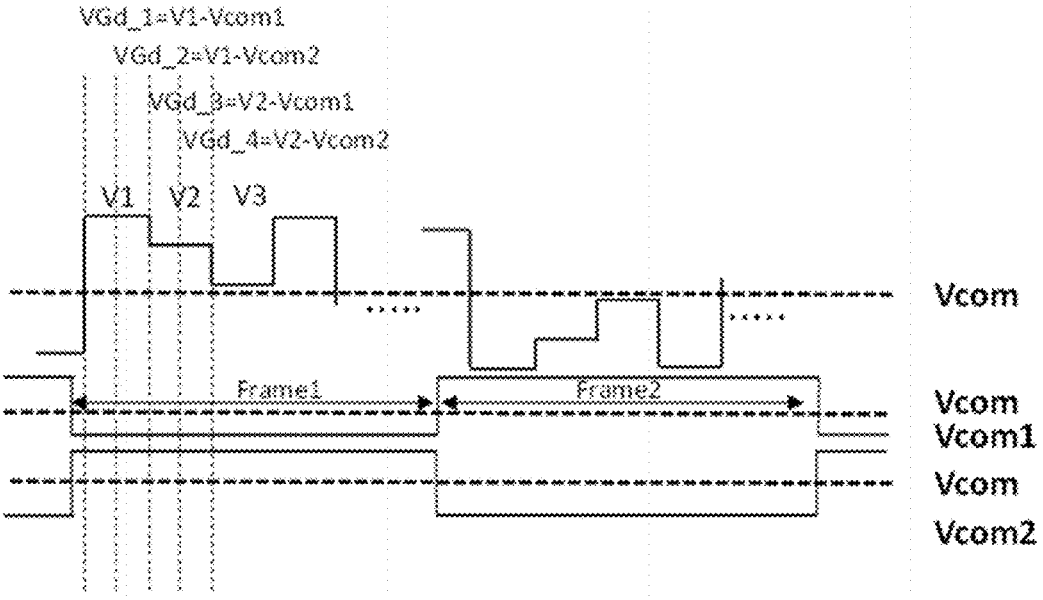

Reference is made to FIG. 4*a*, which is a structural diagram of an embodiment of the display array. FIG. 4*b* is a driving timing diagram corresponding to the display array of this embodiment. The display panel of the display array 30 may be a liquid crystal display panel or other display panels capable of realizing the same or similar functions. This embodiment is not limited to this. In this embodiment, the liquid crystal display panel is taken as an example, the display panel includes a display array including pixel units arranged in an array, and the pixel units include a first pixel unit 10 and a second pixel unit 20. The first pixel unit 10 and the second pixel unit 20 are alternately arranged in a row direction and a column direction, and the first pixel unit 10 and the second pixel unit 20 respectively include a first sub-pixel, a second sub-pixel and a third sub-pixel, the first sub-pixel, the second sub-pixel, and the third sub-pixel respectively correspond to a red sub-pixel (R), a green sub-pixel (G), and a blue sub-pixel (B). The sub-pixels in the first pixel unit are opposite in polarity to the sub-pixels in the second pixel unit.

Figure 5:
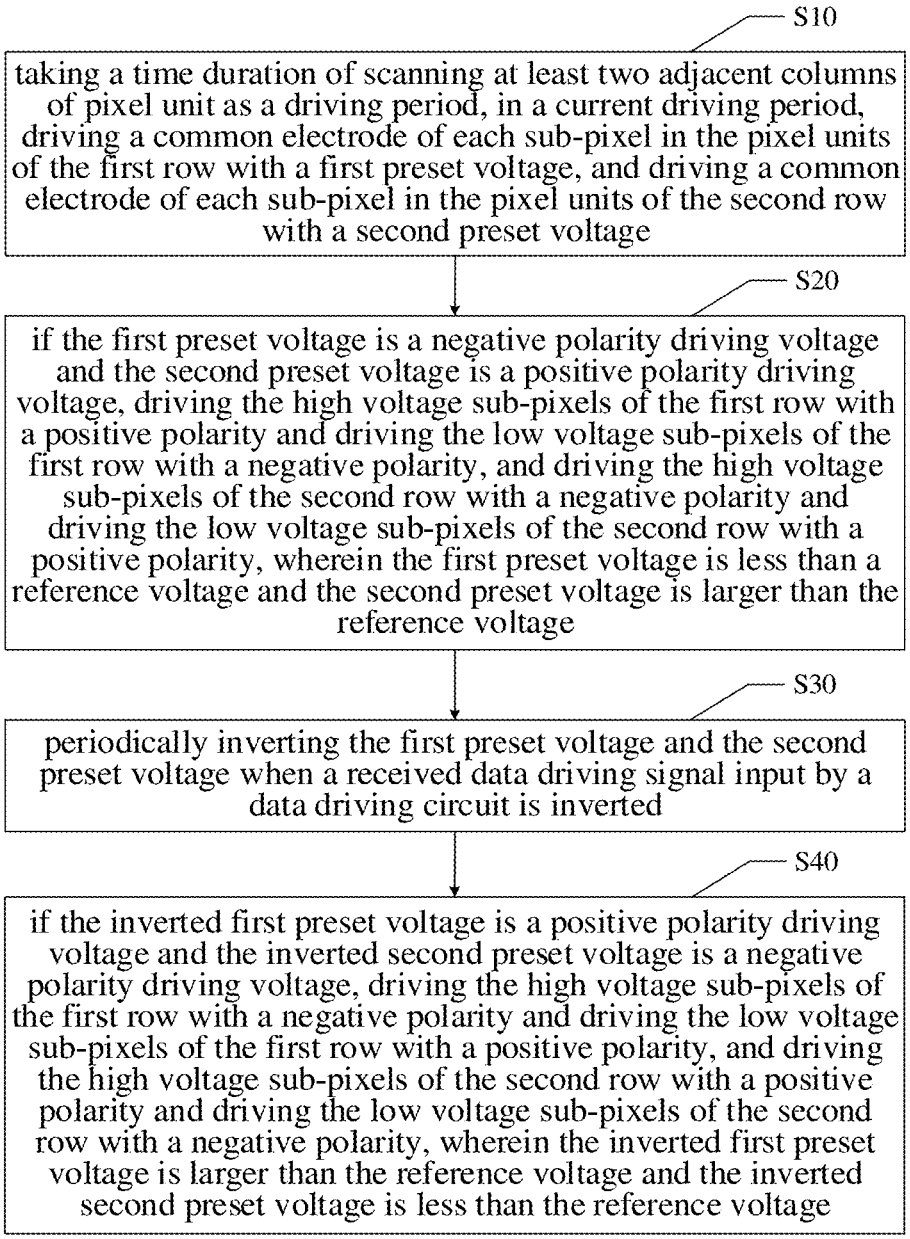
FIG. 5 is a flowchart of an embodiment of a driving method of display panel of the present application.

Referring to FIG. 5, FIG. 5 is a flowchart of the first embodiment of the driving method of the display panel of the present application.

In the first embodiment, the driving method of the display panel includes the following steps:

Step S10, taking a time duration of scanning at least two adjacent columns of pixel unit as a driving period, in a current driving period, driving a common electrode of each sub-pixel in the pixel units of the first row with a first preset voltage, and driving a common electrode of each sub-pixel in the pixel units of the second row with a second preset voltage.

As shown in FIG. 4*a*, the common electrode of the sub-pixels in the first row of pixel units is input to the first predetermined voltage Vcom1, and the common electrode of the sub-pixels in the second row of pixel units is input to the second predetermined voltage Vcom2.

Step S20, if the first preset voltage is a negative polarity driving voltage and the second preset voltage is a positive polarity driving voltage, driving the high voltage sub-pixels of the first row with a positive polarity and driving the low voltage sub-pixels of the first row with a negative polarity, and driving the high voltage sub-pixels of the second row with a negative polarity and driving the low voltage sub-pixels of the second row with a positive polarity, the first preset voltage is less than a reference voltage and the second preset voltage is larger than the reference voltage.

As shown in FIG. 4*b*, when the timing is frame 1 frame, the adjacent R, G, and B sub-pixels of the first row are high and low voltage interleaved driving arrangements, and the frame 1 sequential high voltage sub-pixels are positive driving, low voltage sub-pixels. The pixel is driven by a negative polarity, and the common electrode voltage is driven by a negative voltage. The common electrode voltage Vcom1 is smaller than the original common electrode voltage Vcom, that is, Vcom1<Vcom, and the R, G, and B sub-pixels of the next row are high and low voltage interleaved driving arrangements. In the mode, the frame 1 high-voltage sub-pixel is driven by a negative polarity, and the low-voltage sub-pixel is driven by a positive polarity. The common electrode voltage positive polarity, that is, The common electrode voltage positive polarity, that is, the common electrode voltage Vcom2 is larger than the original common electrode voltage Vcom, that is, Vcom2>Vcom, and the sub-pixels and the common electrode voltages sequentially driven by the respective columns are driven.

Step S30, periodically inverting the first preset voltage and the second preset voltage when a received data driving signal input by a data driving circuit is inverted.

Referring to FIG. 4*a*, in frame 1, the common electrode voltage Vcom1 corresponding to the G column sub-pixel high voltage sub-pixels VGd_1, VGd_3, and VGd_5 is a negative polarity driving voltage, and the common electrode voltage negative polarity, that is, the common electrode voltage Vcom1 is compared with the original common electrode voltage Vcom. Small, i.e. Vcom1<Vcom). The common electrode voltage Vcom2 corresponding to the low voltage subpixels VGd_2, VGd_4, and VGd_6 is a positive polarity driving voltage, and the common electrode voltage positive polarity, that is, the common electrode voltage Vcom2 is larger than the original common electrode voltage Vcom, that is, Vcom2>Vcom. The high voltage sub-pixels VGd_1, VGd_3, VGd_5 and the low-voltage sub-pixels VGd_2, VGd_4, and VGd_6 are positive driving voltages.

With the inversion of the driving signal, the common electrode voltage is also switched with the polarity of the driving reversal frame to switch the periodic voltage, that is, the common electrode voltage Vcom1 becomes the positive driving voltage, and the common electrode voltage positive polarity is the common electrode voltage Vcom1 Relative to the original common electrode voltage Vcom is large, that is, Vcom1>Vcom. The common electrode voltage Vcom2 becomes a negative polarity driving voltage, and the common electrode voltage negative polarity, that is, the common electrode voltage Vcom2 is smaller than the original common electrode voltage Vcom, that is, Vcom2<Vcom, and the high voltage sub-pixels VGd_1, VGd_3, VGd_5 and the low voltage. The sub-pixels VGd_2, VGd_4, and VGd_6 are negative driving voltages.

Step S40, if the inverted first preset voltage is a positive polarity driving voltage and the inverted second preset voltage is a negative polarity driving voltage, driving the high voltage sub-pixels of the first row with a negative polarity and driving the low voltage sub-pixels of the first row with a positive polarity, and driving the high voltage sub-pixels of the second row with a positive polarity and driving the low voltage sub-pixels of the second row with a negative polarity, the inverted first preset voltage is larger than the reference voltage and the inverted second preset voltage is less than the reference voltage.

As shown in FIG. 4*b*, when the timing is frame 2 frame switching, the first row of R, G, and B sub-pixels are inserted into the high-low voltage interleaving driving mode, the high-voltage sub-pixel is driven by the negative polarity, and the low-voltage unit pixel is driven by the positive polarity. With the common electrode voltage positive polarity voltage driving, the common electrode voltage Vcom1 is larger than the original common electrode voltage Vcom, that is, Vcom1>Vcom. The R, G, and B sub-pixels of the next column are high and low voltage interleaved driving arrangements, the high voltage sub-pixel is driven by the positive polarity, the low voltage sub-pixel is driven by the negative polarity, and the common electrode voltage is driven by the negative voltage, and the common electrode voltage Vcom2 is relatively The original common electrode voltage Vcom is small, that is, Vcom2<Vcom). Accordingly, the sub-pixels and the common electrode voltages sequentially inserted in the respective columns are driven.

According to the embodiment, the common electrode voltage adopts a positive and negative polarity timing switching driving mode relative to the original common electrode, the common electrode voltage adopts a driving arrangement of alternating positive and negative polarities according to the row direction, and a driving mode of column inversion is adopted for driving with the same column of sub-pixel driving, so that the frequent driving of data driving lines is reduced, the work of the driving chip is reduced, the power consumption of the driving chip and the temperature rise risk of the driving chip are reduced, the high-voltage pixel unit and the low-voltage pixel unit are alternately arranged and driven, and the problem of viewing angle color deviation is solved.

Further, before step S30, the method further includes:

selecting two adjacent sub-pixels in the same row, driving a high voltage sub-pixel and a low voltage sub-pixel in the selected sub-pixels by the same positive polarity driving voltage.

It should be noted that when the data driving signal is positive driving, two pixels adjacent to the same column are connected to the same data driving signal for driving, thus realizing the sharing of driving signals, reducing the operation of the driving chip, reducing the power consumption of the driving chip and the risk of temperature rise of the driving chip.

Further, before the step S30, the method further includes:

driving a high voltage sub-pixel in the selected sub-pixels with the equivalent driving voltage that is a differential voltage between the driving voltage for positive polarity driving and the first preset voltage; and driving a low voltage sub-pixel in the selected sub-pixels with the equivalent driving voltage that is a differential voltage between the driving voltage for positive polarity driving and the second preset voltage.

As shown in FIG. 4*b*, when the frame 1 frame is timed, the equivalent voltage of the high voltage sub-pixel is VGd_1, which is the voltage difference between the positive polarity driving voltage Vgd=V1 (V1>Vcom) and the negative polarity common electrode power Vcom1. That is, VGd_1=|V1−Vcom1|, the next adjacent low voltage sub-pixel VGd_2 is the voltage difference between the positive polarity driving voltage Vgd=V1 (V1>Vcom) and the positive polarity common electrode power Vcom 2 (Vcom2>Vcom). That is, VGd_2=|V1−Vcom2|, thereby driving the high and low voltage sub-pixels by designing the common electrode driving voltage, thereby reducing wiring and increasing aperture ratio.

Further, after the operation of if the inverted first preset voltage is a positive polarity driving voltage and the inverted second preset voltage is a negative polarity driving voltage, the method further includes:

driving the high voltage sub-pixel in the selected sub-pixels with an equivalent driving voltage larger than that of the low voltage sub-pixel in the selected sub-pixels.

In a specific implementation, as shown in FIG. 4*b*, when the frame 1 frame is timed, the high voltage sub-pixel equivalent driving voltage is VGd_1, that is, the positive polarity driving voltage Vgd=V1 (V1>Vcom) and the negative polarity common electrode electric Vcom1. The voltage difference, that is, VGd_1=|V1−Vcom1|, the next adjacent low voltage sub-pixel VGd_2 is the positive polarity driving voltage Vgd=V1 (V1>Vcom) and the positive polarity common electrode power Vcom 2 (Vcom2>Vcom) The differential pressure, that is, VGd_2=|V1−Vcom2|, so VGd_1>VGd_2. Similarly, the high voltage sub-pixel VGd_3 and the low voltage sub-pixel VGd_4 are driven, and the high-voltage sub-pixel equivalent driving voltage VGd_3 is the positive driving voltage Vgd=V2 (V2>Vcom) and the negative polarity common electrode electric Vcom1 (Vcom1<Vcom). The differential pressure, that is, VGd_3=|V2−Vcom1|, the next adjacent low voltage subpixel VGd_4 is the positive polarity driving voltage Vgd=V2 (V2>Vcom) and the positive polarity common electrode electric Vcom2 (Vcom2>Vcom) The voltage difference, that is, VGd_4=|V2−Vcom2|, so VGd_3>VGd_4, thereby switching between high and low voltages between adjacent sub-pixels, and matching with the data driving signal input when receiving the data driving circuit, The first predetermined voltage and the second predetermined voltage are set to be opposite in polarity, and the driving voltage is periodically inverted, thereby achieving the purpose of reducing color shift.

Further, after the operation of if the inverted first preset voltage is a positive polarity driving voltage and the inverted second preset voltage is a negative polarity driving voltage, the method further includes:

driving an equivalent driving voltage of a high voltage sub-pixel and a low voltage sub-pixel in the selected sub-pixels by a preset data driving signal, and the preset data driving signal is an average signal of driving signals of two adjacent sub-pixels in one original same row.

In this embodiment, the driving signals of the two adjacent sub-pixels in the same column are the driving signals before the improvement, thereby reducing the operating frequency of the driving signal with respect to the driving signal before the improvement, thereby reducing the power consumption of the driving chip.

It should be noted that the VGd_1 and VGd_2 equivalent voltages share the positive polarity driving voltage Vgd=V1 driving and the negative polarity driving voltage Vgd=V1' driving, and the positive polarity driving voltage Vdg1 and the positive polarity driving voltage Vdg2 may preferably be the original frame pixels. The average signal of the signals Gd1 and Gd2 (0 to 255 signals in the case of 8-bit driving signals), that is, G1=(Gd1+Gd2)/2, the positive driving voltage V1 and the negative driving voltage V1' corresponding to the G1 signal. The VGd_3 and VGd_4 equivalent voltages share the positive polarity driving voltage Vgd=V2 and the negative polarity driving voltage Vgd=V2' driving, preferably the average signals of the original pixel signals Gd3 and Gd4 signals (0 to 255 signals for the 8-bit driving signal) That is, G2=(Gd3+Gd4)/2, the positive polarity driving voltage V2 and the negative polarity driving voltage V2' corresponding to the G2 signal.

Further, the periodically inverting the first preset voltage and the second preset voltage when the data drive signal input by the received data drive circuit is inverted includes:

acquiring an inversion signal, and respectively selecting sub-pixels in the same column to be driven in a column inversion mode according to the inversion signal.

In this embodiment, since the pixel units are arranged in columns, the driving method of column inversion can ensure that the voltage polarity stored in each column of subpixels is opposite to the voltage polarity of the subpixels in adjacent columns.

According to the embodiment, at least two rows of pixel units are scanned as a driving period, the common electrodes of each sub-pixel in the pixel units of the preset row are driven by different preset voltages in the current driving period, and the sub-pixel does not need to be driven by double the metal wiring and the driving device to achieve the purpose of saving cost; and when the preset voltage is a positive and negative polarity driving voltage, the high-voltage sub-pixel and the low-voltage sub-pixel in the pixel unit are driven by a preset driving mode, so that, the sub-pixels in the pixel unit are arranged in such a manner that the high and low voltages are crossed, thereby achieving the purpose of solving the visual role deviation.

Figure 6:
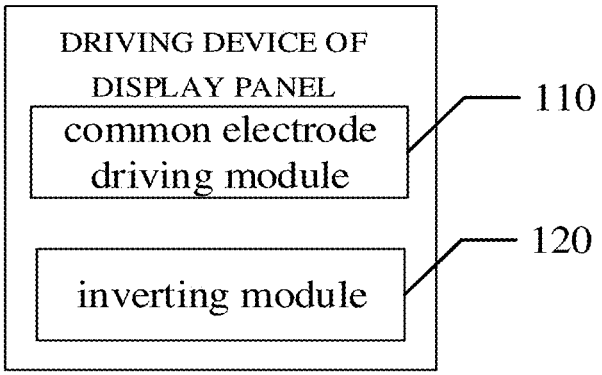
FIG. 6 is a schematic structural diagram of an embodiment of a driving device of display panel of the present application.

In addition, the embodiment of the application also provides a driving device for the display panel. As shown in FIG. 6, the driving device of the display panel includes:

a common electrode driving module 110, being configured to take a time duration of scanning at least two adjacent columns of pixel unit as a driving period, in a current driving period, driving a common electrode of each sub-pixel in the pixel units of the first row with a first preset voltage, and driving a common electrode of each sub-pixel in the pixel units of the second row with a second preset voltage.

The common electrode driving module 110 is also configured to share a data driving signal with adjacent sub-pixels in the same row. When the first preset voltage is a negative driving voltage and the second preset voltage is a positive driving voltage, the high voltage sub-pixels in the first row are driven in a positive polarity, the low voltage sub-pixels are driven in a negative polarity, the high voltage sub-pixels in the second row are driven in a negative polarity, and the low voltage sub-pixels are driven in a positive polarity, the first preset voltage is less than the reference voltage and the second preset voltage is greater than the reference voltage.

An inverting module 120, being configured to periodically invert the first preset voltage and the second preset voltage when the received data drive signal input by the data drive circuit is inverted.

Figure 7:
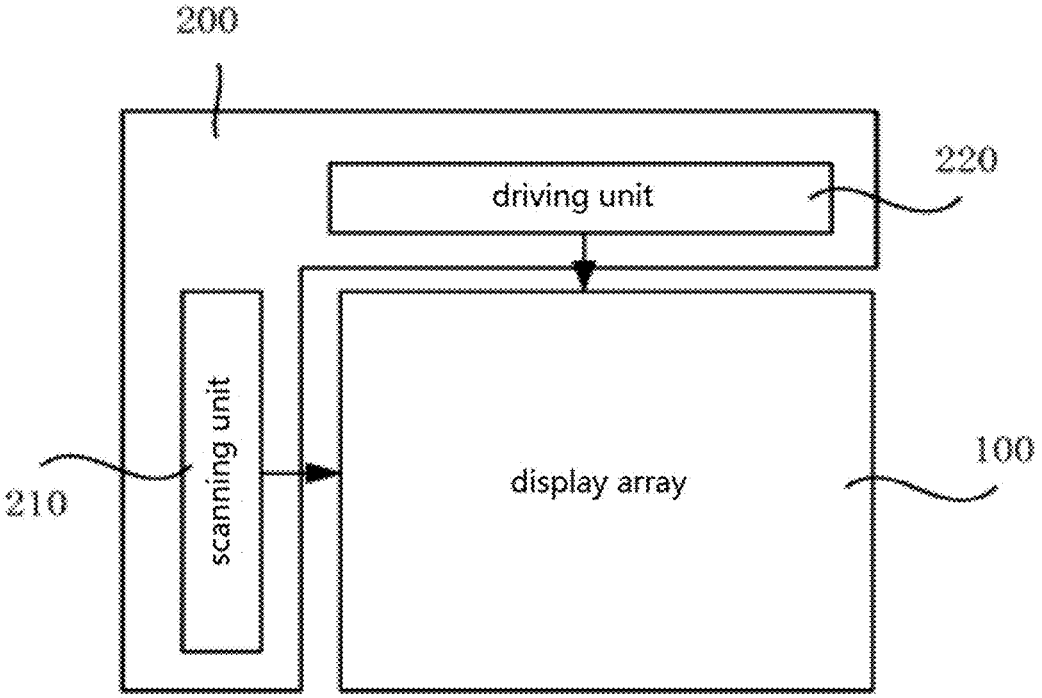
FIG. 7 is a structural diagram of another embodiment of the driving device of display panel of the present application.

The common electrode driving module 110 is further configured to drive the high voltage sub-pixels in the first row with negative polarity, the low voltage sub-pixels with positive polarity, the high voltage sub-pixels in the second row with negative polarity, the low voltage sub-pixels with negative polarity, the low voltage sub-pixels with negative polarity, the low voltage sub-pixels in the second row with negative polarity, the inverted first preset voltage being greater than the reference voltage, and the inverted second As shown in FIG. 7, the driving device of the display panel also includes a display array 100 and a driving module 200. The driving module 200 may include a scanning unit 210 and a driving unit 220. The scanning unit 210 is used to output scanning signals, typically scanning pixel units line by line, and the driving unit 220 outputs driving signals so that pixel units receive driving data for display when being scanned.

The driving module 200 can refer to the above embodiment, through this process, take at least two rows of pixel units scanned as the driving period, and drive the common electrodes of each sub-pixel in the pixel units of the preset row with different preset voltages in the current driving period, without doubling the metal traces and driving devices to drive the sub-pixels, so as to achieve the goal of cost saving, and when the preset voltages are positive and negative polarity driving voltages, drive the high-voltage sub-pixels and the low-voltage sub-pixels in the pixel units in the preset driving mode, thereby setting the sub-pixels in the pixel units to high and low levels.

In addition, the embodiment of the present application also provides a storage medium on which a driving program of display panel is stored, and when the driving program of display panel is executed by the processor, the driving method of display panel as described above is performed.

The above is only the preferred embodiment of the present application and is not therefore limiting the scope of the patent of the present application. The equivalent structure or equivalent process changes made in the application specification and drawings, or directly or indirectly applied in other related technical fields, are similarly included in the patent protection scope of this application.

What is claimed is:

1. A driving method of a display panel for reducing viewing angle color deviation, wherein the display panel comprises a display array, the display array comprises pixel units arranged in an array, each of the pixel units comprises a first pixel unit and a second pixel unit; a polarity of sub-pixels of the first pixel unit are opposite to a polarity of sub-pixels of the second pixel unit, the sub-pixels in the pixel units are arranged in a way of crossing high and low voltages; wherein the driving method comprises:

taking a time duration of scanning at least two adjacent columns of pixel units as a driving period, in a current driving period;

applying a negative polarity driving voltage less than a reference voltage to a common electrode of sub-pixels in the pixel units of a first row, and driving high voltage sub-pixels of the first row with a positive polarity;

applying a positive polarity driving voltage larger than a reference voltage to a common electrode of sub-pixels in the pixel units of a second row, and driving low voltage sub-pixels of the second row with a negative polarity;

periodically inverting the positive polarity driving voltage and the negative polarity driving voltage when a received data driving signal input by a data driving circuit is inverted; and applying the positive polarity driving voltage larger than the reference voltage to the common electrode of sub-pixels in the pixel units of the first row, and driving the high voltage sub-pixels of the first row with the negative polarity; and applying the negative polarity driving voltage less than the reference voltage to the common electrode of sub-pixels in the pixel units of the second row, and driving the low voltage sub-pixels of the second row with the positive polarity.

2. The driving method of claim 1, before the operation of periodically inverting the positive polarity driving voltage and the negative polarity driving voltage when a received data driving signal input by a data driving circuit is inverted, the driving method further comprising:

selecting two adjacent sub-pixels in a same row, driving a high voltage sub-pixel and a low voltage sub-pixel in the selected sub-pixels by a same positive polarity driving voltage.

3. The driving method of claim 2, after the operation of periodically inverting the positive polarity driving voltage and the negative polarity driving voltage when a received data driving signal input by a data driving circuit is inverted, the driving method further comprising:

driving the high voltage sub-pixel in the selected sub-pixels with an equivalent driving voltage that is a differential voltage between the positive polarity driving voltage and the first preset voltage; and driving the low voltage sub-pixel in the selected sub-pixels with an equivalent driving voltage that is a differential voltage between the positive polarity driving voltage and the second preset voltage.

4. The driving method of claim 2, the driving method further comprising:

driving the high voltage sub-pixel in the selected sub-pixels with an equivalent driving voltage larger than an equivalent driving voltage of the low voltage sub-pixel in the selected sub-pixels.

5. The driving method of claim 2, the driving method further comprising:

driving equivalent driving voltages of the high voltage sub-pixel and the low voltage sub-pixel in the selected sub-pixels by a preset data driving signal, and the preset data driving signal is an average signal of driving signals of two adjacent sub-pixels in one original same row.

6. The driving method of claim 1, wherein the operation of periodically inverting the positive polarity driving voltage and the negative polarity driving voltage when a received data driving signal input by a data driving circuit is inverted comprises:

acquiring an inversion signal and selecting sub-pixels in a same column to be driven by a column inversion mode according to the inversion signal.

7. The driving method of claim 1, wherein the pixel units comprises first pixel units and second pixel units, the display array comprises first columns formed by the arranged first pixel units and second columns formed by the arranged second pixel units, the first columns and the second columns are alternately arranged, and any adjacent sub-pixels in the pixel units are alternately arranged with high and low voltages of different polarities.

8. A driving method of reducing viewing angle color deviation of display panel, wherein the display panel comprises a display array, the display array comprises pixel units arranged in an array, the pixel units comprises first pixel units and second pixel units, first columns are all formed by the first pixel units and second columns are all formed by the second pixel units, the first columns and the second columns are alternately arranged, the pixel units sequentially comprises a red sub-pixel, a green sub-pixel, and a blue sub-pixel in a row direction, any adjacent sub-pixels in the pixel units are alternately driven with high and low voltages of different polarities respectively, adjacent sub-pixels in a same column shares one data driving signal, the sub-pixels in the pixel units are arranged in a way of crossing high and low voltages; wherein the driving method comprises:

taking a time duration of scanning at least two adjacent columns of the pixel units as a driving period;

in a current driving period, applying a negative polarity driving voltage less than a reference voltage to a common electrode of sub-pixels in the pixel units of a first row, and driving high voltage sub-pixels of the first row with a positive polarity;

applying a positive polarity driving voltage larger than a reference voltage to a common electrode of sub-pixels in the pixel units of a second row, and driving low voltage sub-pixels of second row with a negative polarity;

periodically inverting the positive polarity driving voltage and the negative polarity driving voltage when a received data driving signal input by a data driving circuit is inverted; and applying the positive polarity driving voltage larger than the reference voltage to the common electrode of sub-pixels in the pixel units of the first row, and driving high voltage sub-pixels of the first row with the negative polarity;

applying the negative polarity driving voltage less than the reference voltage to the common electrode of sub-pixels in the pixel units of the second row, and driving low voltage sub-pixels of the second row with the positive polarity;

selecting two adjacent sub-pixels in a same row, driving the high voltage sub-pixel and the low voltage sub-pixel in the selected sub-pixels by a same positive polarity driving voltage; and driving the high voltage sub-pixel in the selected sub-pixels with an equivalent driving voltage larger than an equivalent driving voltage of the low voltage sub-pixel in the selected sub-pixels.

9. A display device, wherein the display device comprises a display panel, a memory, a non-volatile memory and a processor, the non-volatile memory stores executable instructions, the processor is configured to execute the executable instructions to realize the following operations:

taking a time duration of scanning at least two adjacent columns of pixel units as a driving period, wherein the sub-pixels in the pixel units are arranged in a way of crossing high and low voltages;

in a current driving period, applying a negative polarity driving voltage less than a reference voltage to a common electrode of sub-pixels in the pixel units of a first row, and driving high voltage sub-pixels of the first row with a positive polarity;

applying a positive polarity driving voltage larger than a reference voltage to a common electrode of sub-pixels in the pixel units of a second row, and driving low voltage sub-pixels of second row with a negative polarity;

periodically inverting the positive polarity driving voltage and the negative polarity driving voltage when a received data driving signal input by a data driving circuit is inverted; and applying the positive polarity driving voltage larger than the reference voltage to the common electrode of sub-pixels in the pixel units of the first row, and driving high voltage sub-pixels of the first row with the negative polarity; and applying the negative polarity driving voltage less than the reference voltage to the common electrode of sub-pixels in the pixel units of the second row, and driving low voltage sub-pixels of the second row with the positive polarity.

10. The display device of claim 9, wherein the processor is further configured to execute the executable instructions to realize the following operation: selecting two adjacent sub-pixels in a same row, driving a high voltage sub-pixel and a low voltage sub-pixel in the selected sub-pixels by a same positive polarity driving voltage.

11. The display device of claim 10, wherein the processor is further configured to execute the executable instructions to realize the following operation: driving the high voltage sub-pixel in the selected sub-pixels with an equivalent driving voltage that is a differential voltage between the positive polarity driving voltage and the first preset voltage; and driving the low voltage sub-pixel in the selected sub-pixels with an equivalent driving voltage that is a differential voltage between the positive polarity driving voltage and the second preset voltage.

12. The display device of claim 10, wherein the processor is further configured to execute the executable instructions to realize the following operation: driving the high voltage sub-pixel in the selected sub-pixels with an equivalent driving voltage larger than an equivalent driving voltage of the low voltage sub-pixel in the selected sub-pixels.

13. The display device of claim 10, wherein the processor is further configured to execute the executable instructions to realize the following operation: driving equivalent driving voltages of the high voltage sub-pixel and the low voltage sub-pixel in the selected sub-pixels by a preset data driving signal, and the preset data driving signal is an average signal of driving signals of two adjacent sub-pixels in one original same row.

14. The display device of claim 9, wherein the processor is further configured to execute the executable instructions to realize the following operation: acquiring an inversion signal and selecting sub-pixels in a same column to be driven by a column inversion mode according to the inversion signal.

15. The display device of claim 9, wherein the pixel units comprises first pixel units and second pixel units, the display array comprises first columns formed by the arranged first pixel units and second columns formed by the arranged second pixel units.

16. The display device of claim 9, wherein the first columns and the second column are alternately arranged.

17. The display device of claim 9, wherein any adjacent sub-pixels in the pixel units are alternately driven with high and low voltages of different polarities.

18. The display device of claim 9, wherein the pixel units sequentially comprises a first sub-pixel, a second sub-pixel and a third sub-pixel in a row direction, the first sub-pixel, the second sub-pixel and the third sub-pixel respectively correspond to a red sub-pixel, a green sub-pixel and a blue sub-pixel.

* * * * *